US006752311B2

(12) United States Patent
Tulkoff

(10) Patent No.: US 6,752,311 B2
(45) Date of Patent: Jun. 22, 2004

(54) PIZZA PACKAGING SYSTEM AND METHOD

(76) Inventor: Martin Tulkoff, 3404 Shelburne Rd., Baltimore, MD (US) 21208

( * ) Notice: Subject to any disclaimer, the term of this patent is extended or adjusted under 35 U.S.C. 154(b) by 67 days.

(21) Appl. No.: 10/082,161

(22) Filed: Feb. 26, 2002

(65) Prior Publication Data

US 2002/0079357 A1 Jun. 27, 2002

Related U.S. Application Data

(63) Continuation-in-part of application No. 09/517,065, filed on Mar. 1, 2000, now Pat. No. 6,386,440.

(51) Int. Cl.[7] ..... B65D 5/48

(52) U.S. Cl. ..... 229/104; 229/120; 229/120.06; 229/120.32; 229/906; 229/939; 229/940; 229/942

(58) Field of Search ..... 229/103, 104, 229/120, 120.06, 120.32, 199, 902, 906, 939, 940, 942; 426/115, 119

(56) References Cited

U.S. PATENT DOCUMENTS

| | | | | |
|---|---|---|---|---|
| 519,005 A | | 5/1894 | Reeves, Jr. | |
| 1,499,369 A | | 7/1924 | Holland | |
| 1,607,024 A | | 11/1926 | Thomson | |
| 1,763,416 A | | 6/1930 | Brierley | |
| 1,905,119 A | * | 4/1933 | Newton | 229/104 |
| 1,955,663 A | * | 4/1934 | Wendell et al. | 229/104 |
| 2,108,300 A | | 2/1938 | Sullivan | |
| 2,184,854 A | * | 12/1939 | Spooner | 229/120.32 |
| 2,565,146 A | | 8/1951 | Okon | |
| 2,604,983 A | | 7/1952 | Moore | |
| 2,852,177 A | * | 9/1958 | Frasch | 229/120.32 |
| 3,051,366 A | * | 8/1962 | Sandstrom | 229/104 |
| 3,078,028 A | * | 2/1963 | Skowronski | 229/104 |
| 3,092,300 A | | 6/1963 | Johnson | |
| 3,180,739 A | | 4/1965 | Stoker | |
| 3,197,111 A | | 7/1965 | Kozlowski et al. | |
| 3,275,220 A | | 9/1966 | Hubbard | |
| 3,692,228 A | | 9/1972 | Spiegel | |
| 4,089,458 A | | 5/1978 | Meyers et al. | |
| 4,279,374 A | * | 7/1981 | Webinger | 229/120 |
| 4,301,960 A | | 11/1981 | Alexander et al. | |
| 4,396,115 A | | 8/1983 | Watson | |
| 4,494,689 A | | 1/1985 | Ilitch | |
| 4,844,330 A | | 7/1989 | Roosa et al. | |
| 4,871,111 A | * | 10/1989 | Mode | 229/104 |
| 4,913,340 A | | 4/1990 | Ilitch | |
| 4,944,452 A | | 7/1990 | Kent et al. | |
| 4,957,237 A | | 9/1990 | Madonna et al. | |
| 4,984,734 A | | 1/1991 | Zion et al. | |
| 5,002,221 A | | 3/1991 | Ragan | |

(List continued on next page.)

FOREIGN PATENT DOCUMENTS

| | | |
|---|---|---|
| AU | 741897 | 3/1998 |
| FR | 2577889 | 8/1986 |
| WO | WO -93/19989 A1 | 10/1993 |

*Primary Examiner*—Gary E. Elkins
(74) *Attorney, Agent, or Firm*—Nixon Peabody LLP; Daniel S. Song

(57) ABSTRACT

A pizza packaging system, pizza packaging blank and method for packaging more than one pizza in a stacked configuration. An upper level insert is provided for insertion into the pizza receiving compartment, the upper level insert being elevated above a bottom panel and providing an upper level surface adapted to receive and support a second pizza. The upper level insert is supported by at least one support flap and may be further supported by at least one support member. In addition, the pizza box packaging system and pizza box blank may be provided with perforations to allow the division of the pizza box for use as plates and/or to facilitate disposal. The upper level insert may also be provided with a venting means to allow heat transfer between the pizza receiving compartments, and/or elevating tabs that elevate the pizza box off a support surface.

38 Claims, 4 Drawing Sheets

U.S. PATENT DOCUMENTS

| | | | | |
|---|---|---|---|---|
| 5,014,853 | A | | 5/1991 | Crockett |
| 5,110,038 | A | | 5/1992 | Pantisano et al. |
| 5,180,075 | A | | 1/1993 | Montalbano |
| 5,209,392 | A | | 5/1993 | Anatro |
| 5,351,880 | A | | 10/1994 | Goudreau |
| 5,375,761 | A | | 12/1994 | Sullivan et al. |
| 5,402,930 | A | | 4/1995 | Storms et al. |
| 5,445,314 | A | | 8/1995 | Newsome |
| D362,803 | S | | 10/1995 | McMullen |
| 5,476,214 | A | | 12/1995 | Fisk, Jr. |
| 5,509,601 | A | | 4/1996 | Drabick |
| 5,516,036 | A | | 5/1996 | Maultasch et al. |
| D390,110 | S | | 2/1998 | Mario |
| 5,950,912 | A | | 9/1999 | Economopoulos |
| 6,386,440 | B1 | * | 5/2002 | Tulkoff ..... 229/120.32 |

* cited by examiner

PIZZA PACKAGING SYSTEM AND METHOD

This application is a continuation-in-part of application Ser. No. 09/517,065, filed Mar. 1, 2000, U.S. Pat. No. 6,386,440.

BACKGROUND OF THE INVENTION

1. Field of the Invention

The present invention is related to the field of pizza packaging systems and to methods of using such systems. More specifically, the invention relates to such a pizza packaging system and method for delivering pizzas.

2. Description of Related Art

In recent times, the pizza pie (hereinafter "pizza") has become one of the most popular food dish in the United States and other countries. Pizzas typically have square or round, flat crust upon which tomato sauce and cheese, as well as other ingredients, are placed before baking in an oven. One reason for the popularity of pizzas is the wide variety of toppings which may be included on the pizza to satisfy the diverse tastes of the consumers. Many pizzas are consumed in the restaurant (pizza parlors) where the pizzas are made and purchased. However, a very large portion of pizza sales occur through delivery where the made to order pizzas are physically transported and delivered to the customer at the requested location such as their home or work. Various types of packaging systems have been used but most common packaging systems utilize a cardboard box sized to hold one pizza. Typically, the cardboard box has a square top and bottom but other shapes such as hexagon and octagon have also been used. In addition, pizza boxes made of thin corrugated cardboard have also been used to provide increased rigidity and insulation for the pizza being transported and delivered. In fact, such pizza boxes have become the standard for delivery purposes to ensure that the pizzas contained therein maintain their shape and temperature so that the customers receiving the pizza delivery will be satisfied.

Due to their convenience and popularity, pizzas have become a very popular food item for families, parties and other social gatherings where there may be several or more hungry people. Typically, in such situations, more than one pizza is required because of the number of people or because of the differing tastes of the people involved. Thus, for example, if there are a large number of people gathered, many large pizzas having same or variety of toppings may be ordered for delivery. If the gathering consists, for example, only two people having different topping requirements, two small pizzas having different toppings may be ordered for delivery. In these and other instances, more than one pizza is ultimately delivered to the customer, each pizza being delivered in its own, separate cardboard box as described above and being transported by stacking these pizza boxes on top of each other. However, the cardboard box are an added expense to the pizza merchant who must purchase and provide these boxes essentially for free to the customer for each pizza delivered since competition generally prevents separate charges for such boxes. The costs of these cardboard boxes are further increased if pizza boxes made of corrugated cardboard are used, such corrugated cardboard being more expensive than conventional cardboard. Furthermore, because of the relatively bulky dimensions of such pizza boxes, maintaining adequate inventory of these pizza boxes require much space in the pizza parlor further increasing costs of operating in the pizza business. Moreover, each pizza box needs to be assembled from pizza blanks which requires labor and incurs the associated labor costs for assembly of these pizza blanks. These factors, of course, reduce the profit for the pizza merchant while ultimately increasing the pizza cost for the pizza consumers. In addition, when the large orders require the delivery of numerous pizzas, the delivery person must be very careful that the stacked pizza boxes do not shift relative to one another and fall to the ground. This adds to the difficulty of the delivery persons' task of carrying and delivering the pizzas to the pizza consumers.

In an effort to reduce the costs, various alternative packaging systems have been devised that use a tray to support the pizza such as U.S. Pat. No. 5,180,075 to Montalbano that discloses a pizza packaging system where each pizza is supported by a deliverable, nonreusable, paperboard tray which is enclosed in a sealed paper bag together with the pizza. These pizzas on the paperboard trays are then placed into a reusable insulating outer box through its side so that they may be transported to their consumers where only the pizza, the trays and the bags are delivered and the insulating outer box is retained for reuse in the next delivery. Although this method of delivering pizzas by using a reusable insulating outer box aids in maintaining the pizzas' shape and temperature, it has a disadvantage in that the bag can become stuck on the cheese and/or toppings. In addition, because the reusable insulating box is constructed for reuse, the reusable insulating box is sturdy and heavy thereby increasing the total weight which must be carried by the delivery person. Furthermore, because the insulating box must be reused, it must again, be carried by the delivery person after the delivery of the pizzas has been made. Both of these factors add to the difficulty of the delivery persons' task of carrying and delivering the pizzas to the pizza consumers. In addition, it has been found that such insulating boxes made from corrugated cardboard as taught was not durable enough in that after several reuses, the box began to lose its rigidity making this method of pizza packaging and delivery uneconomical in the long run.

U.S. Pat. No. 5,002,221 to Ragan and U.S. Pat. No. 5,950,912 to Economopoulos both disclose pizza boxes for holding two pizzas that utilizes a shelf to support a second pizza in a stacked configuration above a first pizza. Unlike the Montablano reference, these references disclose deliverable pizza boxes made of cardboard which may be delivered directly to the pizza consumer. To support and properly position the shelf (and correspondingly, the second pizza), the corners of the side walls of these pizza boxes are provided with numerous horizontal cuts so that these corners may be pushed inwardly along the horizontal cuts to form corner shelf supports in the pizza carrying compartment of the pizza box. The Ragan reference also discloses the use of a separator stand for further supporting the shelf. These pizza boxes have been found to avoid many disadvantages of the previously noted prior art pizza packaging systems but have also been found to have many disadvantages of their own as well.

For instance, it has been found that because the corners of the sidewalls in the pizza box are cut and pushed inwardly, the structural rigidity of the resulting assembled pizza box is greatly reduced. This is especially problematic since the pizza box is supposed to support two pizzas which is approximately twice as heavy as one pizza. In addition, because the shelf is only supported at its four corners by the corner shelf supports and at its center by the separator stand, the midportions of the shelf sags along the edges under the weight of the second pizza which is placed on the shelf. Thus, the pizza boxes disclosed in Ragan and Economopoulos references have been found structurally unstable for supporting two pizzas in a stacked configuration.

Furthermore, the corners of the sidewalls which are pushed inwardly to form the corner shelf supports also cause the pizza carrying compartment of the pizza box to be open to the outside environment. This, of course, causes increased heat evacuation from the pizza carrying compartment and undesirably causes the pizzas being transported in the pizza box to be cooled more rapidly. Moreover, when fully assembled, the corners of the sidewalls which have been pushed inwardly to form the corner shelf supports protrude into the pizza carrying compartment thereby reducing the surface area available for supporting and carrying the first pizza. Because most pizzas are circular in shape and the corner shelf supports protrude into the pizza carrying compartment only in the corners, this generally does not pose any problems. However, many pizzas including "pan" pizzas and "Sicilian" pizzas are square or rectangular in shape so that these corner shelf supports can actually prohibit transporting these pizzas in the pizza boxes disclosed in Ragan and Economopoulos.

The pizza boxes disclosed in Ragan and Economopoulos also are cost prohibitive in that the tooling required to provide numerous horizontal cuts at the corners of the side walls are expensive. Moreover, properly pushing inwardly the corners along the horizontal cuts to form corner shelf supports is relatively difficult and labor intensive. Thus, added labor expense is incurred in assembling the pizza box disclosed in the Ragan and Economopoulos references.

Lastly, it has been found by consumers that the conventional pizza boxes are very difficult to discard because of their large size which does not fit into conventional residential garbage cans. This difficulty has been found to be increased if the pizza boxes are made from a corrugated cardboard which is fairly rigid since the boxes cannot be easily folded for disposal. U.S. Pat. No. 5,110,038 to Pantisano et al. discloses a pizza box including slit cuts along a bottom section of the pizza box which can aid the consumer in crushing and disposing the pizza box. However, the disposal of the pizza box is still encumbered since either the box lid or the bottom section must still be disposed of separately from the section of the pizza box provided with the slits.

Therefore, there exists an unfulfilled need for a pizza packaging system, pizza packaging blank and method for delivering more than one pizza which is economical and cost effective. The is also an unfulfilled need for such a pizza packaging system, pizza packaging blank and method which minimizes inventory requirements and assembly costs. There also exists an unfulfilled need for a pizza packaging system and method for delivering more than one pizza that will ensure that the pizzas delivered maintain their shape and temperature so that the customers receiving the pizza delivery will be satisfied. Moreover, there also exists an unfulfilled need for such a pizza packaging system and method for delivering more than one pizza that provides added utility and is easy to discard.

BRIEF SUMMARY OF THE INVENTION

In view of the foregoing, it is an object of the present invention to provide an improved pizza packaging system, pizza packaging blank and a method for delivering more than one pizza which is economical and cost effective.

A second object of the present invention is to provide an improved pizza packaging system and method that minimizes inventory requirements and assembly costs.

A third object of the present invention is to provide an improved pizza packaging system and method for delivering more than one pizza that will ensure that the pizzas delivered maintain their shape and temperature so that the customers receiving the pizza delivery will be satisfied.

Still further, it is an object of the present invention to provide for a pizza packaging system for delivering more than one pizza that is easily to discard.

In accordance with preferred embodiments of the present invention, these objects are obtained by an improved pizza packaging system for packaging more than one pizza in a stacked configuration and for delivery to a consumer comprising a pizza box having a lid panel and a bottom section with a bottom panel bounded by a plurality of side panels extending upwardly from the bottom panel to define a pizza receiving compartment, the bottom panel being adapted to receive and support a first pizza. The lid panel is hingably attached to the bottom section in a manner to provide topographical access to contents placed within the pizza receiving compartment. The pizza packaging system in accordance with the present invention also includes an upper level insert sized to be inserted into the pizza receiving compartment, the upper level insert being elevated above the bottom panel and providing an upper level surface adapted to receive and support a second pizza, the upper level insert including at least one support flap which extends downwardly to support the upper level insert. Preferably, there is provided at least two or even four support flaps disposed on a peripheral edge of the upper level insert such that the flaps abut the plurality of side panels and are supported by the bottom panel to thereby provide edge support for the upper level insert. In this regard, the support flaps may be downwardly foldable portions of the upper level insert.

In accordance with another embodiment of the present invention, the pizza packaging system also comprises at least one supporting means for supporting the upper level insert in the pizza receiving compartment. Preferably, the at least one supporting means is a support member which rests upon and is supported by the first pizza. The support member in one embodiment may be formed as a plastic table having a body portion and a plurality of legs extending therefrom. If only one support member is provided, the support member may be attached to a substantially central location on an underside of the upper level insert. Preferably, three or four support members are provided, the support members being substantially equally spaced distance from a central portion of the first pizza and from one another. Alternatively, the supporting means may be formed as a cutaway on the upper level insert which form downwardly foldable support members.

In accordance with yet another embodiment of the present invention, the bottom panel, at least two of the plurality of side panels and the lid panel, each have perforations adapted to allow division of respective panels along the perforations. In this regard, the perforations on the lid panel corresponds in alignment with the perforations of the bottom panel when the pizza box is in a closed configuration to thereby allow the bottom panel and the lid panel to be divided simultaneously. In addition, the upper level insert may also be provided with similar perforations adapted to allow division of the upper level insert.

In yet another embodiment of the present invention, the upper level insert includes a venting means for forming a vent that allows ventilation between the first pizza and the second pizza to aid in retaining of heat in the pizza box. In this regard, the venting means may include a support panel having an extension that extends into the upper level surface of the upper level insert, the extension being separated from the upper level surface via at least one of a slot cut and a perforation. By this configuration, the vent is formed by downwardly folding the at least one support flap.

In still another embodiment of the present invention, the bottom panel includes at least one slot, and the support flap of the upper level insert includes at least one elevating tab adapted to be inserted through the slot so that the elevating tab protrudes from the bottom panel. In this regard, the elevating tab preferably includes at least one enlarged portion which is sized relative to the slot so that interference fit exists during insertion of the elevating tab into the slot, the enlarged portion preferably being sized relative to the slot so that an edge of the slot catches on the enlarged portion to rest thereon. The slot and the elevating tab allows the pizza box to be elevated off the support surface to minimize heat loss through conductive heat transfer. In another embodiment, a plurality of slots are provided on the bottom panel while a plurality of elevating tabs are provided, the elevating tabs including two enlarged portions.

Moreover, in accordance with preferred embodiments of the present invention, the above noted objects are obtained by an improved pizza packaging blank assemblable into a pizza box for packaging more than one pizza in a stacked configuration and for delivery to a consumer. The pizza packaging blank comprises a bottom panel bounded by a plurality of side panels which are foldable to extend upwardly from the bottom panel to define a pizza receiving compartment when the pizza packaging blank is in an assembled configuration, a lid panel hingably attached to an upper edge of one of the plurality of side panels for providing topographical access to contents placed within the pizza receiving compartment, and an upper level insert which is substantially the same size as the bottom panel for providing an upper level surface, the upper level insert including a plurality of support flaps foldably attached to peripheral edges of the upper level surface. In still another embodiment of the pizza packaging blank, the bottom panel, at least two of the plurality of side panels and the lid panel, each have perforations adapted to allow division of the pizza box along the perforations. In this regard, the upper level insert may also include perforations adapted to allow division of the upper level insert.

In still another embodiment, the upper level insert may include a venting means comprising a support panel having an extension that extends into the upper level surface of the upper level insert, the extension being separated from the upper level surface via at least one of a slot cut and a perforation. By this configuration, the vent is formed by downwardly folding the at least one support flap. In still another embodiment of the present invention, the bottom panel is provided with at least one slot, and the support flap of the upper level insert is provided with at least one elevating tab adapted to be inserted through the slot so that the elevating tab protrudes from the bottom panel. In this regard, the elevating tab may include at least one enlarged portion which is sized relative to the slot so that interference fit exists during insertion of the elevating tab into the slot, the enlarged portion preferably being sized relative to the slot so that an edge of the slot catches on the enlarged portion to rest thereon.

These and other objects, features and advantages of the present invention will become more apparent from the following detailed description of the preferred embodiments of the invention when viewed in conjunction with the accompanying drawings.

DETAILED DESCRIPTION OF THE INVENTION

Figure 1:
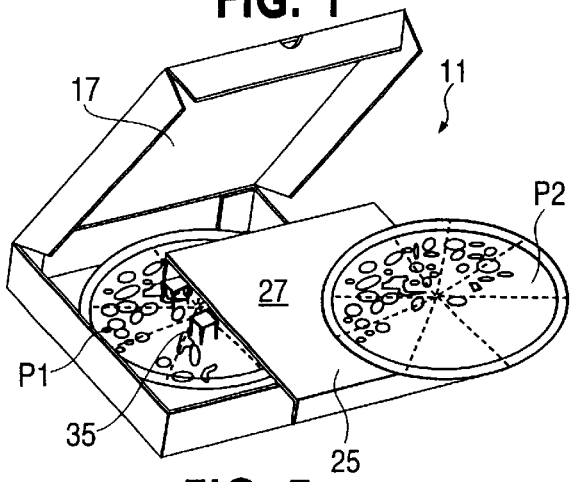
FIG. 1 is a perspective assembly view of a pizza packaging system for delivering more than one pizza in accordance with one embodiment of the present invention.

FIG. 1 illustrates a pizza packaging system 11 in accordance with one embodiment of the present invention which will allow delivery of more than one pizza in an economical and cost effective manner while at the same time, minimizing inventory requirements and assembly costs. In particular, the pizza packaging system 11 illustrated and discussed herein below, allows the delivery of two pizzas while ensuring that the pizzas delivered maintain their shape and temperature so that the customers receiving the pizza delivery will be satisfied. It should be initially noted that although the illustrated preferred embodiment of the pizza packaging system 11 allows packaging and delivery of a first pizza P1 and a second pizza P2 in a stacked configuration shown, the present invention may also be applied to modified pizza packaging systems for packaging and delivering more than two pizzas as well, for instance, three pizzas.

Figure 2:
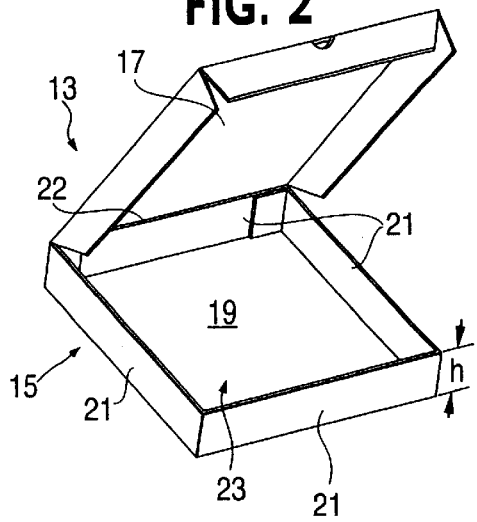
FIG. 2 is a perspective view of the pizza box shown in FIG. 1.

The various components of the pizza packaging system in accordance with one embodiment of the present invention are more clearly illustrated in FIGS. 2–4 as described in detail herein below. As can be seen in FIG. 2, the pizza packaging system 11 includes a pizza box 13 having a bottom section 15 and a lid panel 17. The bottom section 15 includes a bottom panel 19 which is bounded by a plurality of side panels 21 that extend upwardly from the bottom panel 19 to define a pizza receiving compartment 23. The bottom panel 19 is adapted to receive and support the first pizza P1 as shown in FIG. 1. The lid panel 17 is hingably attached to the bottom section 15 in a manner to provide topographical access to contents placed within the pizza receiving compartment 23 so that when the lid panel 17 is opened, the entire pizza is accessible. In this respect, the lid panel 17 may be attached to an upper edge 22 of one of the plurality of side panels 21. Thus, the pizza box 13 in accordance with the preferred illustrated embodiment generally resembles a conventional pizza box. However, in contrast to the conventional pizza boxes, the pizza packaging system 11 in accordance with the present invention also includes an upper level insert 25 as most clearly shown in FIG. 3. The upper level insert 25 is sized to be inserted into the pizza receiving compartment 23 as shown in FIG. 1 so that it is elevated above the bottom panel 19 and provides an upper level surface 27 which is adapted to receive and support the second pizza P2 above the first pizza P1.

Figure 3:
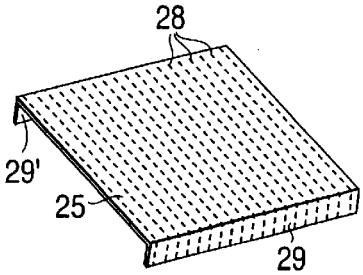
FIG. 3 is a perspective view of the upper level insert shown in FIG. 1.
Figure 4:
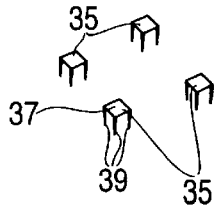
FIG. 4 is a perspective view of the support members shown in FIG. 1.

As can be seen in FIG. 3, the upper level insert 25 in accordance with the illustrated embodiment includes support flaps which extend downwardly to support the upper level insert 25. In the embodiment shown, two support flaps 29 and 29' re disposed on a peripheral edge of the upper level insert 25 such that when the upper level insert 25 is inserted into the pizza receiving compartment 23, the support flaps 29 and 29' abut two of the plurality of side panels 21 and are supported on the bottom panel 19 to thereby provide edge support for the upper level insert 25. In this regard, the support flaps 29 and 29' may be downwardly foldable portions of the upper level insert 25 as shown. In this embodiment, the support flaps 29 should be properly sized to elevate the upper level insert 25 above the surface of the first pizza P1 supported on the bottom panel 19. Although the height dimensions of pizzas differ widely depending on numerous factors including whether it is a "thin crust" or a "thick crust" and the types of toppings present, it has been found that support flaps 29 having a height dimension in the range of about 1 to 2 inches were sufficient to elevate the upper level insert 25 above the surface of common types of pizzas that may be supported on the bottom panel 19. Of course, in a different embodiment, three or four support flaps may be provided and disposed on a peripheral edge of the upper level insert so as to provide even more support for the upper level insert 25.

Moreover, it should be noted that in the preferred embodiment shown, the upper level insert 25 is made from a corrugated cardboard which includes flutes provided between the solid outer panels of the cardboard. In this regard, the flutes 28 (shown in broken/hidden lines) of the corrugated cardboard is preferably oriented to extend between the support flaps 29 and 29' so that the flutes 28 are perpendicularly oriented relative to the support flaps 29 and 29'. This provides added structural rigidity to the upper level insert 25 when only two support flaps are used since this flute orientation minimizes the propensity of the upper level insert 25 to collapse and fold parallel to the support flaps when the second pizza is placed on the upper level insert 25. As can be appreciated, the support flaps 29 and 29; themselves, provide structural rigidity to the upper level insert 25 so that it will not collapse and fold perpendicular to the support flaps.

It should also be readily apparent that the plurality of side panels 21 of the pizza box 13 in accordance with the illustrated embodiment have a height dimension h as shown in FIG. 2 which is enlarged in comparison to conventional pizza boxes. The enlarged height dimension h allows the pizza box 13 to have a pizza receiving compartment 23 which can receive the first pizza P1, the upper level insert 25 and the second pizza P2 in a stacked configuration. In this regard, it has been found that an enlarged height dimension h in the range of about 2 to 4 inches was sufficient enough to allow packaging and deliver of two pizzas in a stacked configuration. Of course, if in alternative embodiments, more than two pizzas are to be packaged and delivered, the height dimension h should be correspondingly increased to accommodate the additional upper level insert(s) (not shown) and the additional pizza(s) (not shown). In such an embodiment, the upper level insert(s) would be stacked upon one another to provided additional pizza packaging capacity.

Referring again to FIG. 1, the pizza packaging system 11 in accordance with the illustrated embodiment also comprises at least one supporting means for supporting the upper level insert 25 in the pizza receiving compartment 23. In the illustrated embodiment, the at least one supporting means are four support members 35 that rest upon and is supported by the first pizza P1 in the manner shown in FIG. 1. One embodiment of these support members 35 are shown in FIG. 4 as being formed as a plastic table having a body portion 37 and a plurality of legs 39 extending therefrom. As can be seen in FIG. 1, the plurality of legs 39 are placed on the first pizza P1 and the body portion 37 contacts and supports the upper level insert 25. The height of the plurality of legs 39 should be properly dimensioned to support the upper level insert 25 in conjunction with the downwardly folded the support flaps 29 and 29' so that the upper level surface 27 is substantially flat. As also shown most clearly in FIG. 4, the contact with the first pizza P1 is minimized since the plurality of legs 39 have very small contact areas at the tip of the legs. Preferably, three or four support members 35 are provided, the support members 35 being substantially equally spaced distance from a center of the first pizza and from one another. Of course, depending on the rigidity of the upper level insert 25, only one support member may be used in other embodiments and may not be needed at all in other embodiments.

Figure 5:
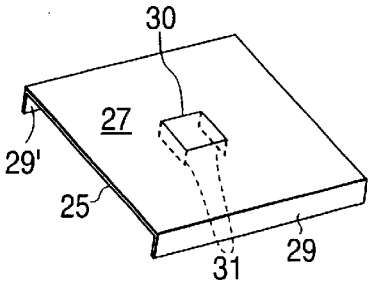
FIG. 5 is a perspective view of an upper level insert in accordance with another embodiment of the present invention.

In an alternative embodiment, the support members 35 may be attached to the underside of the upper level insert 25. In yet another alternative embodiment most clearly shown in FIG. 5, the supporting means may be formed as cutaways 30 that form downwardly foldable support members 31 on the upper level insert 25 itself. While only two downwardly foldable support members 31 are shown, more downwardly foldable support members 31 may also be provided in other embodiments. Moreover, whereas the two downwardly foldable support members 31 are illustrated as being positioned in the center of the upper level insert 27, they may alternatively be positioned offset from the center in other embodiments.

Preferably, the pizza box 13 and the upper level insert 25 are made of corrugated cardboard so that the pizza box 13 is sufficiently strong and rigid enough to support the first and second pizzas P1 and P2 in the pizza receiving compartment 23 while the upper level insert 25 is sufficiently rigid enough to support the second pizza P2 in conjunction with the support members 35. For instance, corrugated cardboard conventionally used for pizza boxes may be used. Alternatively, a 100 lb test corrugated cardboard may be used for both the pizza box 13 and the upper level insert 25. Of course, other grades of cardboard/paperboard or even other types of materials may also be used for these components in accordance with the present invention as well. In addition, if more than two pizzas are to be packaged and delivered, even stronger corrugated cardboard or other materials may also be used.

Figure 6A:
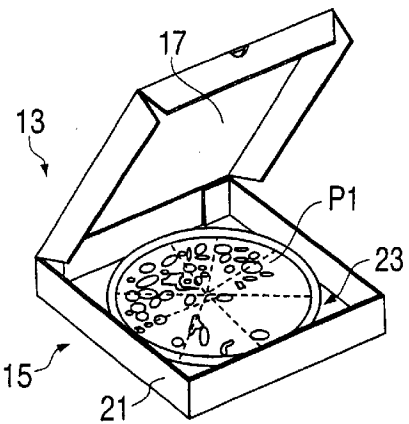
FIGS. 6A–6F together illustrate one method of using the pizza packaging system of FIG. 1 to package more than one pizza.
Figure 6B:
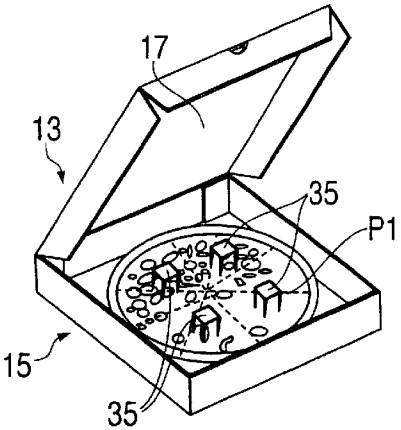
Figure 6C:
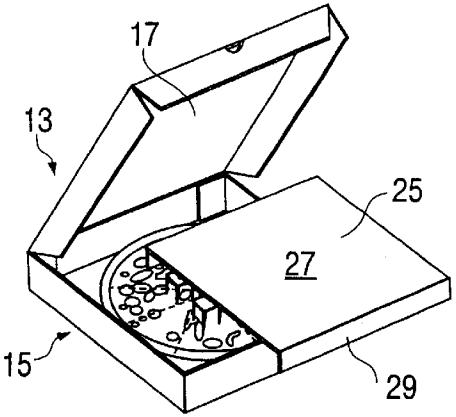
Figure 6D:
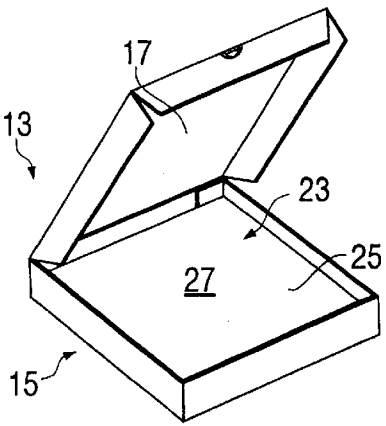
Figure 6E:
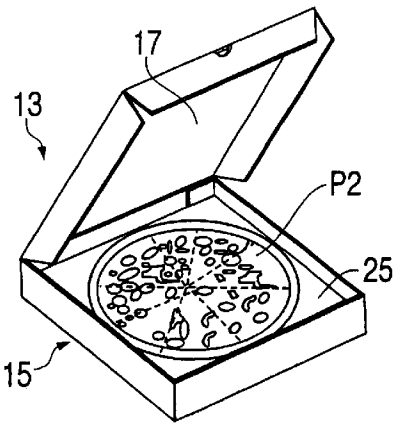
Figure 6F:
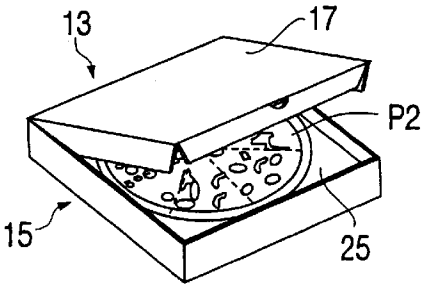

FIGS. 6A through 6F together illustrate one preferred method of using the pizza packaging system 11 of FIG. 1 to package the first pizza P1 and the second pizza P2 in the manner shown. In particular, the method in accordance with the present invention includes the steps of providing a pizza box 13 having a bottom section 15 with a pizza receiving compartment 23 and a lid panel hingably attached thereto as described above. FIG. 6A illustrates the first pizza P1 which is inserted into the pizza receiving compartment 23 in a manner that the first pizza is supported on the bottom panel 19 (shown in FIG. 2). Four support members 35 are placed substantially equally spaced distance from the center of the first pizza P1 and from one another as shown in FIG. 6B. As can be seen in FIG. 6C, the two support flaps 29 and 29' disposed on a peripheral edge of the upper level insert 25 are folded downwardly and the upper level insert 25 is then inserted into the pizza receiving compartment 23 as shown in FIG. 6D to provide an upper level surface 27 which is elevated above the first pizza P1. The second pizza P2 is then inserted into the pizza receiving compartment 23 of the pizza box 13 as shown in FIG. 6E so that the second pizza P2 is supported on the upper level surface 27 provided by the upper level insert 25. As can be appreciated, the support flaps 29 and 29' provide edge support to the upper level insert 25 so that the upper level insert 25 does not collapse under the weight of the second pizza P2. As can also be readily appreciated, the four support members 35 act to provide support to the upper level insert 25 so that the center portions of the upper level insert 25 will not collapse under the weight of the second pizza P2. Of course, depending on the embodiment of the present invention, the packaging method may instead include the step of downwardly folding a cutaway (not shown) on the upper level insert 25 to form downwardly foldable support members as described relative to FIG. 5.

Figure 7:
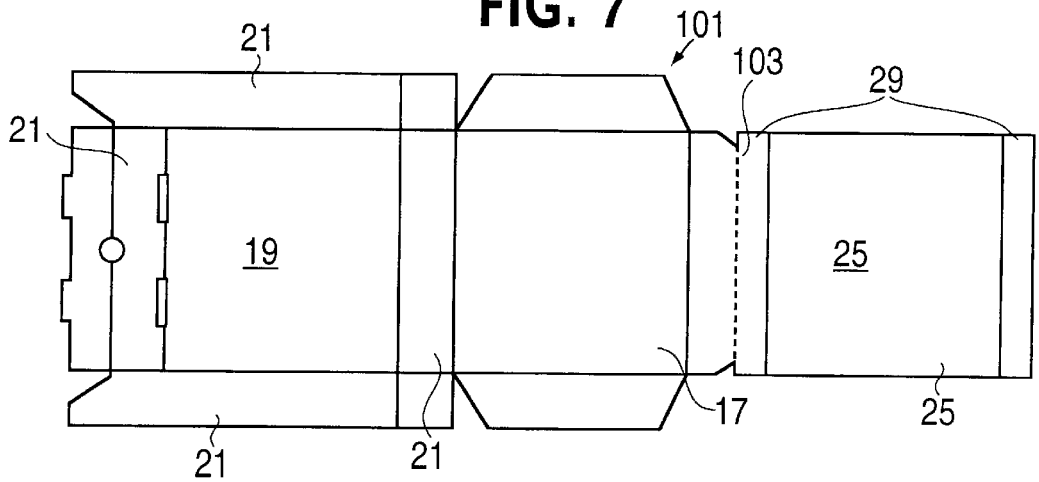
FIG. 7 is a top view of a pizza packaging blank which is assemblable in to the pizza box of FIG. 2 and the upper level insert of FIG. 3.

FIG. 7 illustrates a pizza packaging blank 101 in accordance with one embodiment of the present invention which is assemblable into a pizza box 13 and an upper level insert 25 of FIG. 1 for packaging more than one pizza in a stacked configuration and for delivery to a consumer. The numerous portions of the pizza packaging blank 101 have been enumerated using the corresponding numerals used in FIGS. 1 to 4. As can be seen, the pizza packaging blank 101 comprises a bottom panel 19 which is bounded by a plurality of side panels 21 which in turn, are foldable to extend upwardly from the bottom panel 19 to define a pizza receiving compartment when the pizza packaging blank 101 is in an assembled configuration as discussed above relative to FIG. 2. A lid panel 17 is hingably attached to an upper edge of one of the plurality of side panels 21 for providing topographical access to contents placed within the pizza receiving compartment when the pizza packaging blank 101 is assembled. An upper level insert 25 which is substantially same size as the bottom panel 19 is detachably provided on the pizza packaging blank 101 so that it can be detached to provide the upper level surface 27. In this regard, perforations 103 may be provided between the joined portions of the pizza packaging blank and the upper level insert 25 to facilitate its detachment. In the illustrated embodiment of the pizza packaging blank 101 in FIG. 7, the upper level insert 25 also includes a plurality of support flaps 29 foldably attached to peripheral edges of the upper level surface 25 in the manner shown. In yet other embodiments of the pizza packaging blank 101, the upper level insert 25 may include a downwardly foldable cutaway (not shown).

The pizza packaging blank 101 may be made of corrugated cardboard such as those conventionally used for pizza boxes may be used or a 100 lb test corrugated cardboard may be used. Of course, other grades of cardboard/paperboard, or even other types of materials, may also be used as well depending on the application of the present invention.

Figure 8:
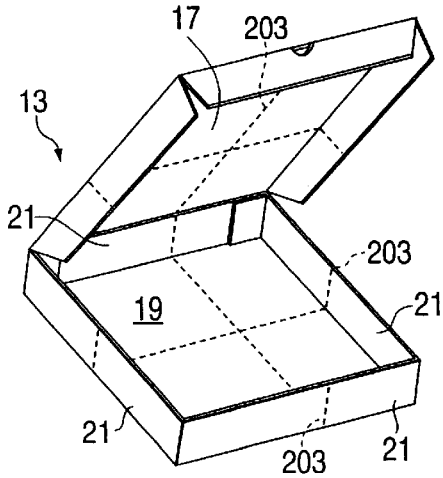
FIG. 8 is a perspective view of the pizza box in accordance with another embodiment of the present invention including perforations that provide increased utility and ease of disposal for the pizza box.

FIG. 8 shows yet another alternative embodiment of the pizza box 13 which includes perforations 203 that provide increased utility and ease of disposal for the pizza box 13. As can be clearly seen, the bottom panel 19, the plurality of side panels 21 and the lid panel 17, each have perforations 203 that allow division of the respective panels along the perforations 203. This embodiment allows the pizza consumer to divide these panels along the perforations 203 and to use the divided parts of the panels for disposable plates for serving the pizzas P1 and P2. Of course, the upper level insert 25 (not shown) may also be provided with such perforations so that it too may be divided into parts for disposable plate use. This feature is very useful since large quantities of pizza are typically ordered for relatively casual gatherings where disposable plates would likely be used anyway but may not be readily available. In this manner, the perforations 203 of the pizza box 13 provide added utility to the pizza consumer.

Even if these panels are not used as disposable plates, the perforations 203 allow easier disposal of the pizza box 13 than was previously possible with prior art pizza boxes. As noted previously, because of the relatively awkwardly large and flat shape of the pizza boxes, they are difficult to dispose of. This difficulty is compounded in larger boxes that package large pizzas which can be up to 16 inches or more in diameter. The perforations 203 allow the pizza consumer to more easily divide the pizza box 13 into smaller parts so that it may be readily disposed of. In contrast to the prior art pizza boxes where such perforations are provided only on either the lid panel or on the bottom section of the pizza box, the perforations 203 are provided both on the lid panel 17 and on the bottom section 15, including the side panels 21 and the bottom panel 19, so that the consumer can simply close the lid panel 17 and divide the pizza box 13 along the perforation. In this regard, the perforations on the lid panel 17 are made to correspond and align with the perforations of the bottom panel 19 when the pizza box 13 is in a closed configuration to thereby allow the bottom panel 19 and the lid panel 17 to be divided simultaneously. As can be appreciated, this allows the pizza box 13 to be divided into four small components which may then, be easily discarded. In addition, the upper level insert (not shown) may also be provided with similar perforations adapted to allow division of the upper level insert as well.

Figure 9:
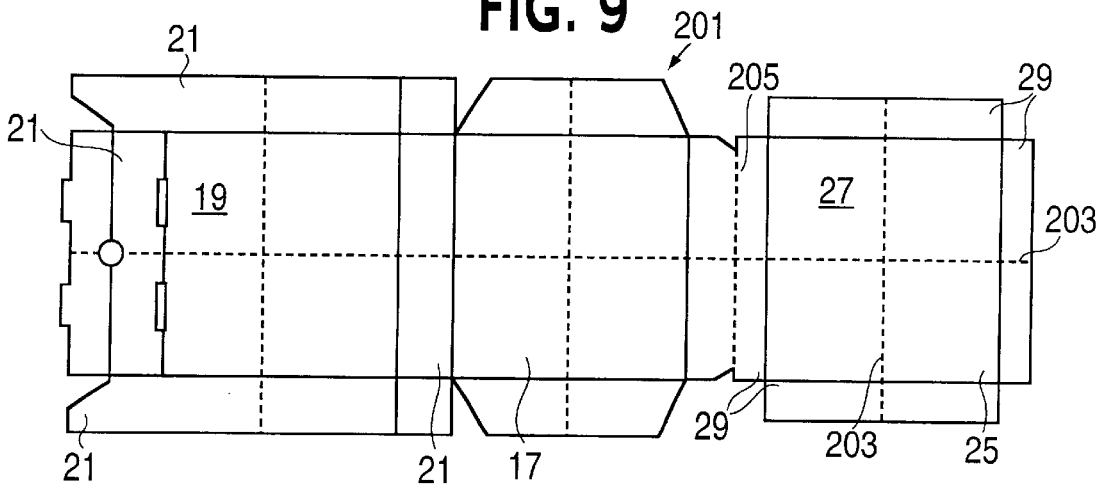
FIG. 9 is a top view of a pizza packaging blank which is assemblable in to the pizza box of FIG. 8.

FIG. 9 illustrates a pizza packaging blank 201 in accordance another embodiment of the present invention which is assembled to provide the pizza box 13 of FIG. 8 and an upper level insert (not shown) for packaging more than one pizza in a stacked configuration and for delivery to a consumer. Again, the numerous portions of the pizza packaging blank 201 have been enumerated using the corresponding numerals used in FIGS. 1 to 4. As can be seen, the pizza packaging blank 201 comprises a bottom panel 19 which is bounded by a plurality of side panels 21 which are foldable to define a pizza receiving compartment. A lid panel 17 is hingably attached to an upper edge of one of the plurality of side panels 21 for providing topographical access to contents placed within the pizza receiving compartment when the pizza packaging blank 201 is assembled. In the illustrated embodiment of the pizza packaging blank 201, the upper level insert 25 also includes a four support flaps 29 foldably attached to peripheral edges of the upper level surface 25 in the manner shown. An upper level insert 25 is detachably provided on the pizza box blank 201 so that it can be detached to provide the upper level surface 27. In this regard, perforations 205 may be provided between the joined portions of pizza packaging blank 201 and one of the support flaps 29. Moreover, the perforations 203 extend through the lid panel 17, the side panels 21 and the bottom panel 19 as well as the upper level insert 25 and its support flaps 29 to allow division of the assembled pizza box of FIG. 8. Thus, it can be readily appreciated how upon assembly, the pizza box blank 201 illustrated in FIG. 9 would provide a pizza box 13 as embodied in FIG. 8 that may be divided into four small components for disposal or for use as disposable plates. Of course, like the pizza box blank of FIG. 7, the pizza box blank 201 of FIG. 8 may be further modified so that the upper level insert 25 may include a downwardly foldable cutaway (not shown).

Figure 10:
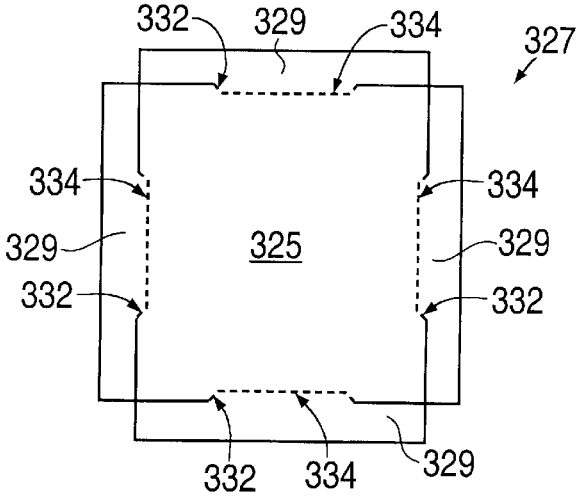
FIG. 10 is a top view of another embodiment of the upper level insert in accordance with the present invention having a venting feature.

FIG. 10 shows an upper level insert 327 in accordance with yet another embodiment of the present invention which may be used in the manner generally described above. The upper level insert 327 differs from the insert 27 described previously in that it incorporates a venting feature which forms a vent when the support flaps 329 are downwardly folded to allow ventilation through the upper level insert 327. As can be seen, four support flaps 329 are foldably attached to peripheral edges of the upper level surface 325 which supports the second pizza in the manner described above. However, as can be seen in FIG. 10, the support flaps 329 also include an extension 332 that extends into the upper level surface 325, these extensions 332 being separated from the upper level surface 325 via a slot cut 334 which is illustrated here as perforations for clarity purposes. Of course, the slot cut 334 may be in fact, perforations but preferably, the slot cut 334 are actual separations cut via a die to facilitate proper downward folding of the support flaps 329. Thus, when the support flaps 329 of the upper level insert 327 are downwardly folded for insertion into the pizza box, the slot cuts 334 allow the extensions 332 open a part of the upper level surface 325 to thereby form a vent which is more clearly shown in FIG. 11 discussed below.

Figure 11:
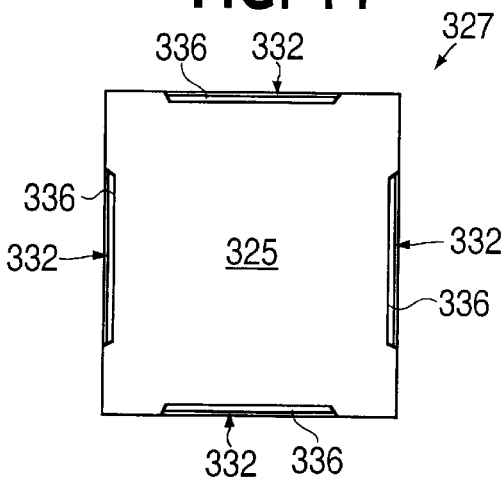
FIG. 11 is a top view of the upper level insert of FIG. 10 with the support flaps folded downward.

FIG. 11 more clearly shows the vents 336 that are formed on the upper level insert 327 when the support flaps 332 are folded downward for use. As can be seen, because the extensions 332 extend into the upper level surface 325, when the support flaps 329 are downwardly folded, the extensions 332 separate from the upper level surface along the die cuts 334 shown in FIG. 10 thereby creating vents 336 that allow ventilation between the lower level which contains the first pizza and the upper level which contains the second pizza. This ventilation between the pizza receiving compartments provided by the vents 336 has been found by the present applicant to promote heat retention between the pizzas stored in a pizza box in accordance with the present invention. Such ventilation has also been found by the present applicant to minimize condensation from accumulating on the bottom panel of the pizza box which can weaken the bottom panel. As can be appreciated, the bottom panel will typically have the most amount of load to support as compared to the various other panels of the pizza box. Thus, by allowing ventilation between the and minimizing condensation accumulation, the vents 336 aid increase the performance of the pizza box in accordance with the present invention. Of course, the upper level insert 327 may also be manufactured together with the pizza box in the manner described relative to FIGS. 7 and 9. In addition, different types of vents may be provided instead in other embodiments to allow ventilation such as push through tabs or venting holes. However, the vents 336 shown in FIG. 11 have been found to be advantageous in that the vents are automatically formed when the support panels 329 are downwardly folded thereby minimizing time and energy expended by the person assembling the upper level insert 327.

Figure 12:
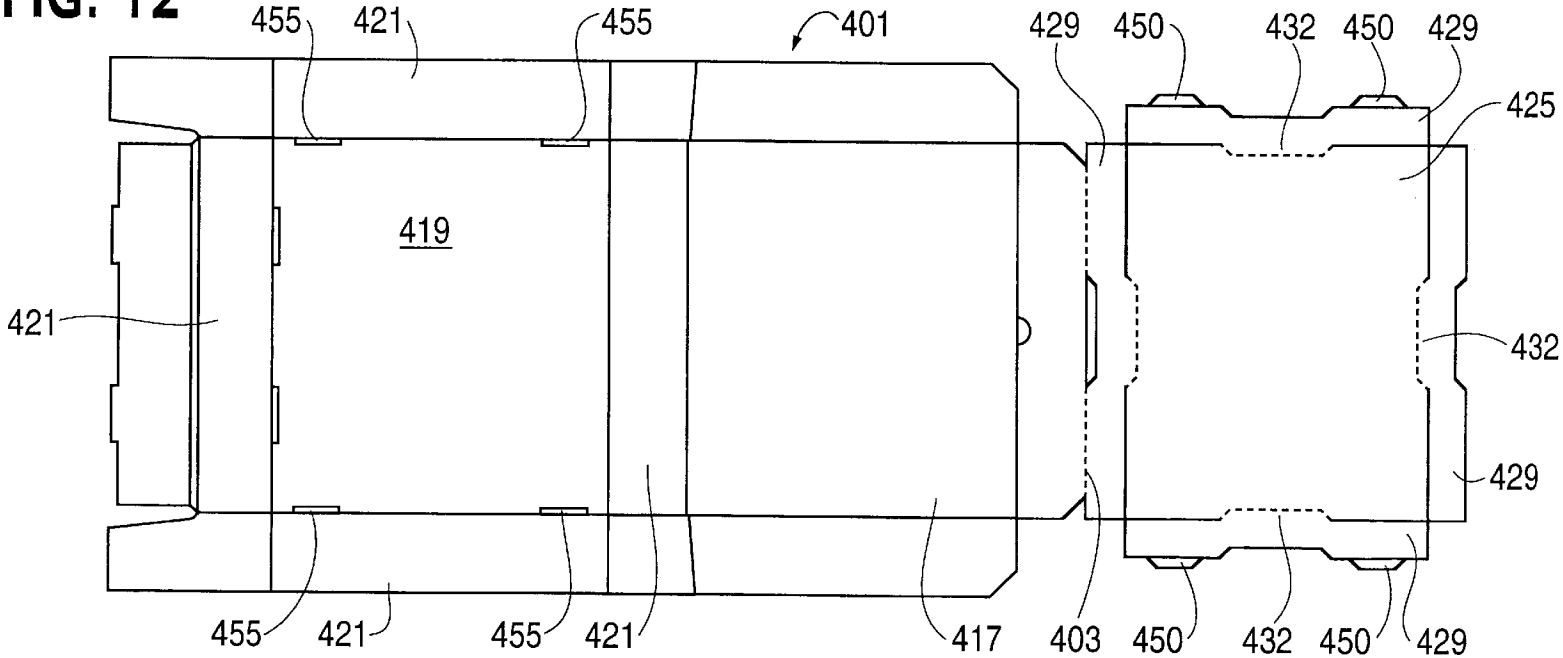
FIG. 12 is a top view of a pizza packaging blank which includes provisions for elevating the pizza box assembled therefrom.

FIG. 12 is a top view of a pizza packaging blank 401 which includes provisions for elevating the pizza box assembled therefrom as described in further detail below. Like the pizza packaging blank 101 shown in FIG. 7, the pizza packaging blank 401 includes an upper level insert 425 for allowing packaging of more than one pizza in a stacked configuration and for delivery to a consumer. The pizza packaging blank 401 comprises a bottom panel 419 which is bounded by a plurality of side panels 421 which in turn, are foldable to extend upwardly from the bottom panel 419 to define a pizza receiving compartment when the pizza packaging blank 401 is in an assembled configuration. A lid panel 417 is hingably attached to an upper edge of one of the plurality of side panels 421 for providing topographical access to contents placed within the pizza receiving compartment when the pizza packaging blank 401 is assembled. An upper level insert 425 which is substantially same size as the bottom panel 419 is detachably provided on the pizza packaging blank 401 so that it can be detached to provide the upper level surface. In this regard, perforations 403 may be provided between the joined portions of the pizza packaging blank and the upper level insert 425 to facilitate its detachment.

In the illustrated embodiment of the pizza packaging blank 401 of FIG. 12, the upper level insert 425 also includes a plurality of support flaps 429 foldably attached to peripheral edges of the upper level surface 425 in the manner shown. The upper level insert 425 shown incorporates the venting feature discussed above relative to FIG. 10 which forms a vent when the support flaps 429 are downwardly folded. In this regard, the support flaps 429 also include extensions 432 so that when the support flaps 429 of the upper level insert 427 are downwardly folded for insertion into the assembled pizza box, the extensions 432 form a vent as previously described relative to FIG. 11.

Furthermore, in the illustrated embodiment of the pizza packaging blank 401, the upper level insert 425 also includes a plurality of elevating tabs 450 which are provided on two opposing support flaps 429. These elevating tabs 450 are sized to be inserted and received in corresponding slots 455 that are provided on the bottom panel 419. When the elevating tabs 450 are received in the slots 455, the elevating tabs 450 elevate the pizza box as explained in detail below.

Figure 14:
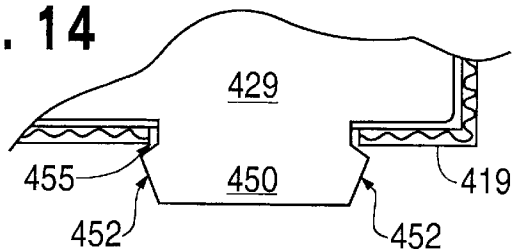
FIG. 14 is an enlarged, partial cross-sectional view of one corner of the pizza packaging box of FIG. 13.
Figure 13:
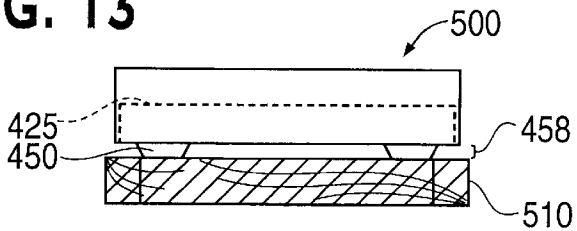
FIG. 13 is a side profile view of the pizza packaging box which was assembled to from the pizza packaging blank of FIG. 12.

In the above regard, FIG. 13 shows a pizza box 500 which has been assembled from the pizza packaging blank 401 of FIG. 12, the assembled pizza box being placed on a support surface such as the table top 510 shown. An enlarged partial cross-sectional view of one elevating tab 450 is shown in FIG. 14 for clarity. As can be seen, the elevating tabs 450 of the support flaps 429 on the upper level insert 425 protrude out of the slots 455 of the bottom panel 419 in the installed configuration as most clearly shown in FIG. 14. Because there are a plurality of elevating tabs 450, each positioned proximate to a corner of the pizza box 500 in the present illustrated embodiment, the assembled pizza box 500 is elevated off the support surface such as the table top 510 in the illustrated manner.

By elevating the pizza box 500 off the support surface such as the table top 510, an air gap 458 is created between the bottom panel 419 and the support surface. The air gap 458 insulates the pizza box 500 and reduces heat transfer between the pizza box 500 and the support surface. In this manner, the temperature of the pizza(s) stored in the pizza box 500 can be better retained for a longer duration than for conventional pizza boxes in which the bottom panel contacts the support surface which allows conductive heat transfer to occur. To ensure that the box does not unintentionally drop to the support surface, the elevating tabs 450 are provided with enlarged portions 452 as shown in FIG. 14. These enlarged portions 452 are sized to cause interference fit with the slots 455 of the bottom panel 419, and to allow the edges of the slots 455 to catch on the enlarged portions 452 to thereby rest thereon.

It should be noted that whereas in the illustrated embodiment of FIGS. 12 to 14, the elevating tabs 450 are provided on two of the plurality of support flaps 429, additional elevating tabs 450 may also be provided on the other support flaps as well or even on one support flap. Such an embodiment would cause tilting of the pizza box and thus, would not be as desirable as the present illustrated embodiment unless other elevating provisions are made in the pizza box, for instance, on a side panel. Moreover, whereas two elevating tabs 450 are provided, different number of elevating tabs may be provided in other embodiments. For instance, one elevating tab may be provided on each of the plurality of support flaps so that the pizza box is elevated by four tabs, one on each support flap. In addition, the upper level insert may be provided with the vent described above relative to FIGS. 10 and 11 to maintain the temperature of the pizzas stored in the pizza box.

From the foregoing, it should now be apparent how the present invention provides an improved pizza packaging system and method which will allow delivery of more than one pizza in an economical and cost effective manner. By providing a pizza packaging system with a pizza box which can hold more than one pizza, the present invention eliminates the need for individual pizza boxes for the additional pizzas delivered. This minimizes the expenses of such boxes to the pizza parlor owner and minimizes inventory requirements and assembly costs since each of the pizza box blanks can package more than one pizza. For instance, in the above discussed embodiment, only one pizza box blank need be inventoried and assembled to deliver two pizzas (or even more than two pizzas in other embodiments). Of course, this reduces inventory, material and operational costs for the pizza parlor thereby increasing profits to the pizza parlor and/or decrease pizza costs to the consumer.

In addition, it can be seen how the present invention avoids the disadvantages of the pizza boxes disclosed in U.S. Pat. No. 5,002,221 to Ragan and U.S. Pat. No. 5,950,912 to Economopoulos. In particular, the corners of the pizza box in accordance with the present invention remains intact such that the box is very rigid and can support the weight of two or even more pizzas without deforming. Moreover, because the upper level insert is supported along its periphery by the downwardly foldable flaps, it is resistant to sagging and thus, the pizza box in accordance with the present invention ensures that the pizzas delivered maintain their shape. In addition, because the corners of the pizza box are not exposed to the environment like the boxes in Ragan and Economopoulos, the pizzas are delivered hot and ready to eat. Furthermore, because the downwardly foldable flaps eliminate the need for corner shelf supports required in Ragan and Economopoulos, the present invention maximizes the space available in the pizza carrying compartment and consequently, allows the transport of square or rectangular pizzas. Costs are substantially reduced since the requirement for numerous horizontal cuts on the sidewalls of the pizza box is eliminated and the time consuming assembly of the corner shelf supports is also eliminated. In accordance with another embodiment of the present invention, perforations are provided on the pizza packaging system so as to provide added utility for the consumer in that the perforations allow parts of the pizza box and/or the upper level insert to be used as disposable plates and also allows easy disposal of the pizza packaging system.

Moreover, it should be evident how the present invention may be used to improve heat retention for the pizzas stored in the pizza box. This is attained in accordance with one embodiment of the present invention by providing a vent on the upper level insert to allow ventilation through the upper level insert so that heat is allowed to transfer between the pizzas stored in the pizza box. In another embodiment, the pizza box is elevated off the support surface by providing elevating tabs on at least one support flap thereby minimizing conductive heat transfer from the pizza box to the support surface.

While various embodiments in accordance with the present invention have been shown and described, it is understood that the invention is not limited thereto. These embodiments may be changed, modified and further applied by those skilled in the art. For instance, as previously noted, the present invention may be used to package and deliver more than two pizzas. In addition, numerous features disclosed and discussed above can also be used in combination. Of course, features commonly known in the prior art pizza boxes can also be incorporated into the pizza packaging system of the present invention. For instance, features for outside venting and facilitating stacking as well as other features can also be provided. Therefore, this invention is not limited to the details shown and described previously but also includes all such changes and modifications which are encompassed by the appended claims.

What is claimed is:

1. A pizza packaging system for packaging more than one pizza in a stacked configuration and for delivery to a consumer comprising:

a pizza box having a bottom section and a lid panel, said bottom section including a bottom panel bounded by a plurality of side panels extending upwardly from said bottom panel to define a pizza receiving compartment, said bottom panel being adapted to receive and support a first pizza, and said lid panel being hingably attached to said bottom section in a manner to provide topographical access to contents placed within said pizza receiving compartment; and a removable upper level insert sized to be inserted into said pizza receiving compartment, said upper level insert including at least three downwardly foldable support flaps, each downwardly foldable support flap extending downwardly and contacting said bottom panel to support said upper level insert elevated above said bottom panel and providing an upper level surface adapted to receive and support a second pizza, said upper level insert further including a vent formed upon downwardly folding said at least one support flap.

2. A pizza packaging system of claim 1, wherein said vent is formed by an extension provided on said at least one support flap, said extension extending upwardly from said upper level surface of said upper level insert.

3. A pizza packaging system of claim 2, wherein said extension is separated from the upper level surface via at least one of a slot cut and a perforation.

4. A pizza packaging system of claim 3, wherein said at least one support flap is at least two support flaps disposed opposite one another on peripheral edges of said upper level insert.

5. A pizza packaging system of claim 4, wherein said upper level insert is made of corrugated cardboard having flutes, said flutes extending between said at least two support flaps and being oriented perpendicular to said at least two support flaps.

6. A pizza packaging system of claim 1, further comprising at least one supporting means for supporting said upper level insert in said pizza receiving compartment.

7. A pizza packaging system of claim 6, wherein said at least one supporting means is formed as a downwardly foldable support member on said upper level insert.

8. A pizza packaging system of claim 1, wherein said bottom panel, at least two of said plurality of side panels and said lid panel, each have perforations adapted to allow division of respective panels along said perforations, said perforations on said lid panel corresponding in alignment with said perforations of said bottom panel when said pizza box is in a closed configuration thereby allowing said bottom panel and said lid panel to be divided simultaneously.

9. A pizza packaging system for packaging more than one pizza in a stacked configuration and for delivery to a consumer comprising:

a pizza box having a bottom section and a lid panel, said bottom section including a bottom panel bounded by a plurality of side panels extending upwardly from said bottom panel to define a pizza receiving compartment, said bottom panel being adapted to receive and support a first pizza, and said lid panel being hingably attached to said bottom section in a manner to provide topographical access to contents placed within said pizza receiving compartment;

an upper level insert sized to be inserted into said pizza receiving compartment, said upper level insert including at least one downwardly foldable support flap which extends downwardly to support said upper level insert elevated above said bottom panel and providing an upper level surface adapted to receive and support a second pizza, said upper level insert further including a vent formed upon downwardly folding said at least one support flap; and at least one supporting means for supporting said upper level insert in said pizza receiving compartment;

wherein said at least one supporting means is a support member which rests upon and is supported by the first pizza supported on said bottom panel.

10. A pizza packaging system for packaging more than one pizza in a stacked configuration and for delivery to a consumer comprising:

a pizza box having a bottom section and a lid panel, said bottom section including a bottom panel bounded by a plurality of side panels extending upwardly from said bottom panel to define a pizza receiving compartment, said bottom panel being adapted to receive and support a first pizza, and said lid panel being hingably attached to said bottom section in a manner to provide topographical access to contents placed within said pizza receiving compartment; and an upper level insert sized to be inserted into said pizza receiving compartment, said upper level insert including at least one downwardly foldable support flap which extends downwardly to support said upper level insert elevated above said bottom panel and providing an upper level surface adapted to receive and support a second pizza, said upper level insert further including a vent formed upon downwardly folding said at least one support flap;

wherein said bottom panel includes at least one slot, and said at least one support flap of said upper level insert includes at least one elevating tab adapted to be inserted through said at least one slot so that the elevating tab protrudes from said bottom panel.

11. A pizza packaging system of claim 10, wherein said at least one elevating tab includes at least one enlarged portion which is sized relative to said at least one slot so that interference fit exists during insertion of said at least one elevating tab into said at least one slot.

12. A pizza packaging system of claim 11, wherein said at least one enlarged portion is sized relative to said at least one slot so that an edge of said at least one slot catches on said at least one enlarged portion to rest thereon.

13. A pizza packaging system of claim 12, wherein said at least one enlarged portion is two enlarged portions sized so that edges of said at least one slot catches on said two enlarged portions.

14. A pizza packaging system of claim 10, wherein said at least one slot is a plurality of slots provided on said bottom panel and said at least one elevating tab is a plurality of elevating tabs adapted to protrude through said plurality of slots.

15. A pizza packaging system for packaging more than one pizza in a stacked configuration and for delivery to a consumer comprising:

a pizza box having a bottom section and a lid panel, said bottom section including a bottom panel bounded by a plurality of side panels extending upwardly from said bottom panel to define a pizza receiving compartment, said bottom panel being adapted to receive and support a first pizza and having at least one slot, and said lid panel being hingably attached to said bottom section in a manner to provide topographical access to contents placed within said pizza receiving compartment; and an upper level insert sized to be inserted into said pizza receiving compartment, said upper level insert including at least one downwardly foldable support flap which extends downwardly to support said upper level insert elevated above said bottom panel and providing an upper level surface adapted to receive and support a second pizza, said at least one support flap having at least one elevating tab adapted to be inserted through said at least one slot of said bottom panel so that said elevating tab protrudes from said bottom panel.

16. A pizza packaging system of claim 15, wherein said at least one elevating tab includes at least one enlarged portion which is sized relative to said at least one slot so that interference fit exists during insertion of said at least one elevating tab into said at least one slot.

17. A pizza packaging system of claim 16, wherein said at least one enlarged portion is sized relative to said at least one slot so that an edge of said at least one slot catches on said at least one enlarged portion to rest thereon.

18. A pizza packaging system of claim 17, wherein said at least one enlarged portion is two enlarged portions sized so that edges of said at least one slot catches on said two enlarged portions.

19. A pizza packaging system of claim 15, wherein said at least one slot is a plurality of slots provided on said bottom panel and said at least one elevating tab is a plurality of elevating tabs adapted to protrude through said at least one slot.

20. A pizza packaging system of claim 15, further comprising at least one supporting means for supporting said upper level insert in said pizza receiving compartment.

21. A pizza packaging system of claim 20, wherein said at least one supporting means is a support member which rests upon and is supported by the first pizza supported on said bottom panel.

22. A pizza packaging system of claim 20, wherein said at least one supporting means is formed as a downwardly foldable support member on said upper level insert.

23. A pizza packaging system of claim 15, wherein said bottom panel, at least two of said plurality of side panels and said lid panel, each have perforations adapted to allow division of respective panels along said perforations, said perforations on said lid panel corresponding in alignment with said perforations of said bottom panel when said pizza box is in a closed configuration thereby allowing said bottom panel and said lid panel to be divided simultaneously.

24. A pizza packaging blank assemblable into a pizza box for packaging more than one pizza in a stacked configuration and for delivery to a consumer comprising:

a bottom panel bounded by a plurality of side panels which are foldable to extend upwardly from said bottom panel to define a pizza receiving compartment when said pizza packaging blank is in an assembled configuration;

a lid panel hingably attached to an upper edge of one of said plurality of side panels for providing topographical access to contents placed within said pizza receiving compartment; and a removable upper level insert which is substantially same size as said bottom panel for providing an upper level surface, said upper level insert including at least three support flaps that extend to contact said bottom panel for supporting said upper level insert, said upper level insert further including a vent formed upon downwardly folding said at least one support flap.

25. A pizza packaging blank of claim 24, wherein said vent is formed by an extension provided on said at least one support flap, said extension extending into said upper level surface of said upper level insert.

26. A pizza packaging blank of claim 25, wherein said extension is separated from the upper level surface via at least one of a slot cut and a perforation.

27. A pizza packaging blank of claim 24, wherein said bottom panel, at least two of said plurality of side panels and said lid panel, each have perforations adapted to allow division of said pizza box along said perforations.

28. A pizza packaging blank assemblable into a pizza box for packaging more than one pizza in a stacked configuration and for delivery to a consumer comprising:

a bottom panel bounded by a plurality of side panels which are foldable to extend upwardly from said bottom panel to define a pizza receiving compartment when said pizza packaging blank is in an assembled configuration;

a lid panel hingably attached to an upper edge of one of said plurality of side panels for providing topographical access to contents placed within said pizza receiving compartment; and an upper level insert which is substantially same size as said bottom panel for providing an upper level surface, said upper level insert including at least one support flap for supporting said upper level insert, said upper level insert further including a vent formed upon downwardly folding said at least one support flap;

wherein said vent is formed by an extension provided on said at least one support flap, said extension extending into said upper level surface of said upper level insert; and wherein said upper level insert includes a cutaway which forms a downwardly foldable support member.

29. A pizza packaging blank assemblable into a pizza box for packaging more than one pizza in a stacked configuration and for delivery to a consumer comprising:

a bottom panel bounded by a plurality of side panels which are foldable to extend upwardly from said bottom panel to define a pizza receiving compartment when said pizza packaging blank is in an assembled configuration;

a lid panel hingably attached to an upper edge of one of said plurality of side panels for providing topographical access to contents placed within said pizza receiving compartment; and an upper level insert which is substantially same size as said bottom panel for providing an upper level surface, said upper level insert including at least one support flap for supporting said upper level insert, said upper level insert further including a vent formed upon downwardly folding said at least one support flap;

wherein said bottom panel includes at least one slot, and said at least one support flap of said upper level insert includes at least one elevating tab adapted to be inserted through said at least one slot so that said elevating tab protrudes from said bottom panel upon assembly.

30. A pizza packaging blank of claim 29, wherein said at least one elevating tab includes at least one enlarged portion which is sized relative to said at least one slot so that interference fit exists during insertion of said at least one elevating tab into said at least one slot.

31. A pizza packaging blank of claim 30, wherein said at least one enlarged portion is sized relative to said at least one slot so that an edge of said at least one slot catches on said at least one enlarged portion to rest thereon.

32. A pizza packaging blank of claim 29, wherein said at least one slot is a plurality of slots provided on said bottom panel and said at least one elevating tab is a plurality of elevating tabs adapted to protrude through said at least one slot.

33. A pizza packaging blank assemblable into a pizza box for packaging more than one pizza in a stacked configuration and for delivery to a consumer comprising:

a bottom panel bounded by a plurality of side panels which are foldable to extend upwardly from said bottom panel to define a pizza receiving compartment when said pizza packaging blank is in an assembled configuration, said bottom panel having at least one slot;

a lid panel hingably attached to an upper edge of one of said plurality of side panels for providing topographical access to contents placed within said pizza receiving compartment; and an upper level insert which is substantially same size as said bottom panel for providing an upper level surface, said upper level insert including at least one support flap for supporting said upper level insert, said at least one support flap having at least one elevating tab;

wherein said at least one elevating tab is adapted to be inserted through said at least one slot of said bottom panel during assembly so that the elevating tab protrudes from said bottom panel.

34. A pizza packaging blank of claim 33, wherein said at least one elevating tab includes at least one enlarged portion which is sized relative to said at least one slot so that interference fit exists during insertion of said at least one elevating tab into said at least one slot.

35. A pizza packaging blank of claim 34, wherein said at least one enlarged portion is sized relative to said at least one slot so that an edge of said at least one slot catches on said at least one enlarged portion to rest thereon.

36. A pizza packaging blank of claim 33, wherein said at least one slot is a plurality of slots provided on said bottom panel and said at least one elevating tab is a plurality of elevating tabs adapted to protrude through said at least one slot.

37. A pizza packaging blank of claim 33, wherein said upper level insert includes a cutaway which forms a downwardly foldable support member.

38. A pizza packaging blank of claim 33, wherein said bottom panel, at least two of said plurality of side panels and said lid panel, each have perforations adapted to allow division of said pizza box along said perforations.

* * * * *